US011382361B2

(12) United States Patent
Johnson, II

(10) Patent No.: US 11,382,361 B2
(45) Date of Patent: Jul. 12, 2022

(54) GARMENT WITH CONVERTIBLE SLEEVE CUFFS

(71) Applicant: Struck X LLC, Southfield, MI (US)

(72) Inventor: Charles Anthony Johnson, II, New York, NY (US)

( * ) Notice: Subject to any disclaimer, the term of this patent is extended or adjusted under 35 U.S.C. 154(b) by 361 days.

(21) Appl. No.: 16/278,432

(22) Filed: Feb. 18, 2019

(65) Prior Publication Data

US 2019/0174835 A1 Jun. 13, 2019

Related U.S. Application Data

(63) Continuation-in-part of application No. 15/248,040, filed on Aug. 26, 2016, now abandoned.

(51) Int. Cl.

| | |
|---|---|
| ***A41B 7/04*** | (2006.01) |
| ***A41B 7/10*** | (2006.01) |
| ***A41B 7/02*** | (2006.01) |
| *A41F 1/00* | (2006.01) |
| *A41D 15/00* | (2006.01) |

(52) U.S. Cl.

CPC ..... *A41B 7/10* (2013.01); *A41B 7/02* (2013.01); *A41B 7/04* (2013.01); *A41B 2300/30* (2013.01); *A41D 15/00* (2013.01); *A41F 1/002* (2013.01)

(58) Field of Classification Search

CPC .... A41B 7/02; A41B 7/04; A41B 7/06; A41B 7/08; A41B 7/10; A41B 7/00; A41B 2300/00; A41B 2300/30; A41B 3/02; A41B 3/06; A41B 3/08; A41B 3/14; A41B 3/16

USPC ..... 2/141.2

See application file for complete search history.

(56) References Cited

U.S. PATENT DOCUMENTS

| | | | | |
|---|---|---|---|---|
| 1,017,414 A * | 2/1912 | Heichelbech | ..... | A41B 3/12 2/137 |
| 7,404,215 B2 * | 7/2008 | Allen | ..... | A41D 27/12 2/231 |
| 2013/0318683 A1 * | 12/2013 | Blakely | ..... | A41B 7/10 2/124 |

* cited by examiner

*Primary Examiner* — Timothy K Trieu

(74) *Attorney, Agent, or Firm* — Kristin Grant; Grant Attorneys at Law

(57) ABSTRACT

The present invention presents a garment with convertible sleeve cuffs comprising of a body having a right sleeve and a left sleeve, wherein the right sleeve and the left sleeve each start at a wearers right shoulder and left shoulder respectively and reach a wearers right wrist and left wrist respectively, and a garment sleeve cuff attached to the wrist end of each of the right sleeve and the left sleeve, the garment sleeve cuffs each comprising of a first extension comprising of a connector, the connector comprising of two or more corresponding parts, and a second extension comprising of a connector, the connector comprising of two or more corresponding parts.

7 Claims, 7 Drawing Sheets

GARMENT WITH CONVERTIBLE SLEEVE CUFFS

CROSS REFERENCE TO RELATED APPLICATIONS

This application is a continuation-in-part of application Ser. No. 15/248,040 filed on Aug. 26, 2016.

BACKGROUND

Field of the Invention

The present invention is directed to a garment having a sleeve cuff, and more particularly to a garment having a sleeve cuff where the cuff can be converted into a plurality of styles.

Related Art

The present invention provides a stylish garment with convertible sleeve cuffs. Distinct from other garments with convertible sleeve cuffs which are solely for allowing varying sleeve lengths as disclosed in U.S. Pat. No. 2,641,765A for example, the convertible sleeve cuff in the present invention comprises of connectors specifically and discreetly placed such that the sleeve cuff can be converted into a plurality of styles.

SUMMARY OF THE INVENTION

It is to be understood that the phraseology and terminology employed herein are for the purpose of the description and should not be regarded as limiting.

The present invention is directed to a garment having convertible sleeve cuffs for providing the wearer with a number of versatile looks. The invention comprising of a garment with sleeves wherein each sleeve has a sleeve cuff attached to its wrist end. The sleeve cuff comprising of a wrist portion, a first extension extending longitudinally from one end of the wrist portion, a second extension extending longitudinally from the opposite end of the wrist portion, and a connector comprising of two or more corresponding parts for securing the first extension to the second extension when the sleeve cuff is manipulated into a particular style. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
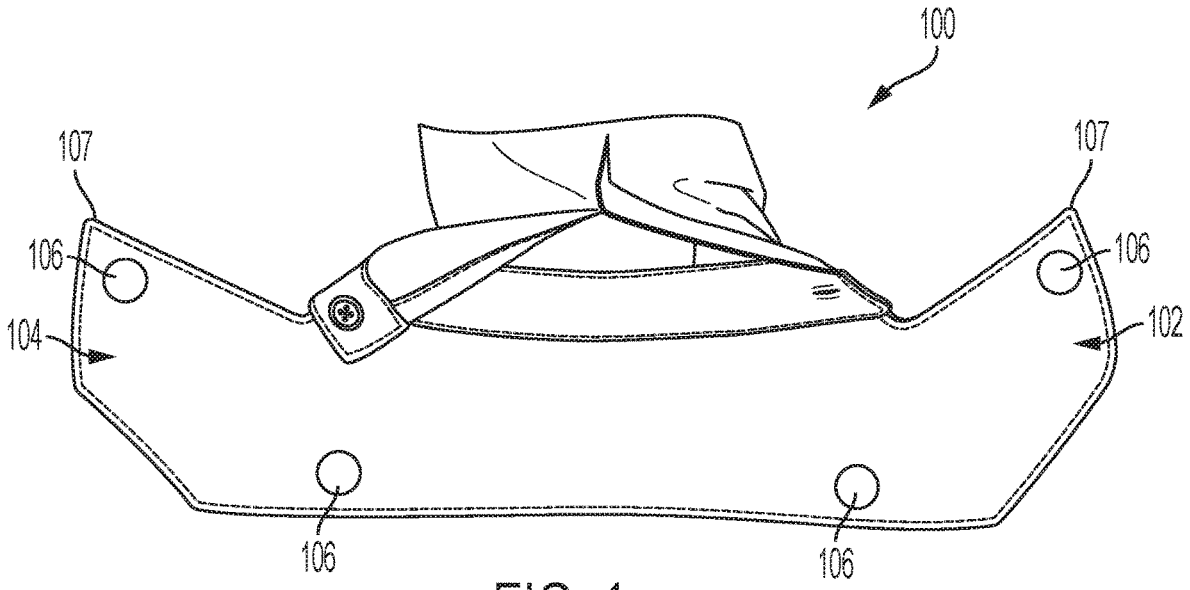
FIG. 1 is a perspective view of a sleeve of a garment with convertible sleeve cuffs according to an embodiment of the present invention.

Referring now to the figures, where similar reference characters denote similar elements throughout, FIG. 1 shows a perspective view of a sleeve of a garment with convertible sleeve cuffs 100 according to an embodiment of the present invention, each sleeve cuff comprising of a first extension 102 and a second extension 104. The first extension 102 and the second extension 104 each having a connector 106, the connector 106 comprising of two or more corresponding parts. The connector 106 preferably comprising of magnets but may comprise of male and female connectors and fasteners, hook and eye fasteners, hook and loop fasteners, buttons, or other similar connectors typically known in the art for securing the first extension 102 and the second extension 104 to one another or to other areas on the convertible sleeve cuff 100 when the convertible sleeve cuff 100 is manipulated into different styles. One or more parts of the connector 106 are on the tip 107 of the first extension 102 and one or more parts of the connector 106 are on the base 105 of the first extension 102. The connector may be secured to, detachable from, or removable from the convertible sleeve cuff 100.

Figure 2:
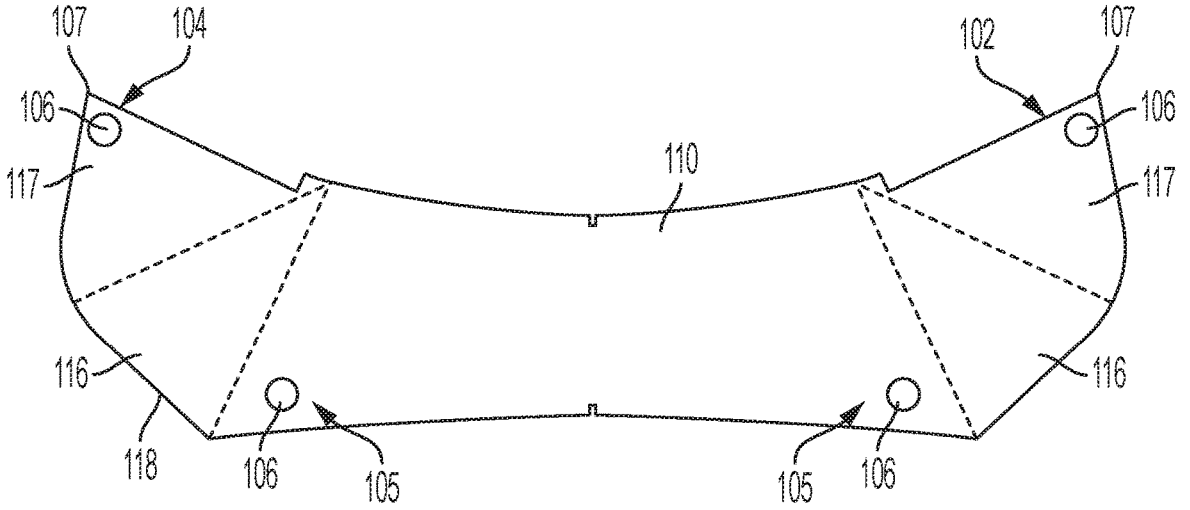
FIG. 2 is a front view of a sewing pattern for a convertible sleeve cuff according to an embodiment of the present invention.

FIG. 2 shows a front view of a sewing pattern for a convertible sleeve cuff according to an embodiment of the present invention. The pattern comprising of a first extension 102 longitudinally extending from one end of a wrist portion 110 and a second extension 104 longitudinally extending from the opposite end of the wrist portion 110 wherein the first extension 102 and second extension 104 are mirror images. The first extension 102 and the second extension 104 each having a tip 107 and a base 105 wherein the base 105 is an area where the wrist portion 110 meets the extension 102, 104 and the tip 107 is at the end of the respective extension 102, 104 distal from the base 105. Each extension 102, 104 comprising of two triangles 116, 117 one or more parts of the connector 106 at the tip 107, and one or more parts of the connector 106 at the base 105. The one or more parts of the connector 106 at the base 105 are located proximal to the base 118 of first triangle 116 at a distance away from the first triangle 116 that is between 0 to ¾ of the length of the side of the first triangle 116. In a size medium garment with standard measurements of the typical size medium wearer, the triangles 116, 117 preferably have a base width of approximately 2¾ inches. The sewing pattern, as shown in FIG. 2 is graded up and down according to grading techniques typically known in the art.

In some embodiments of the present invention the convertible sleeve cuffs 100 are detachable from the garment. Attachment/detachment means may comprise of zip fasteners, hook and eye fasteners, hook and loop fasteners, buttons, magnets, or other similar attachment means generally known in the art. In some embodiments the connectors 106 are detachable from the sleeve cuffs 100.

Figure 3:
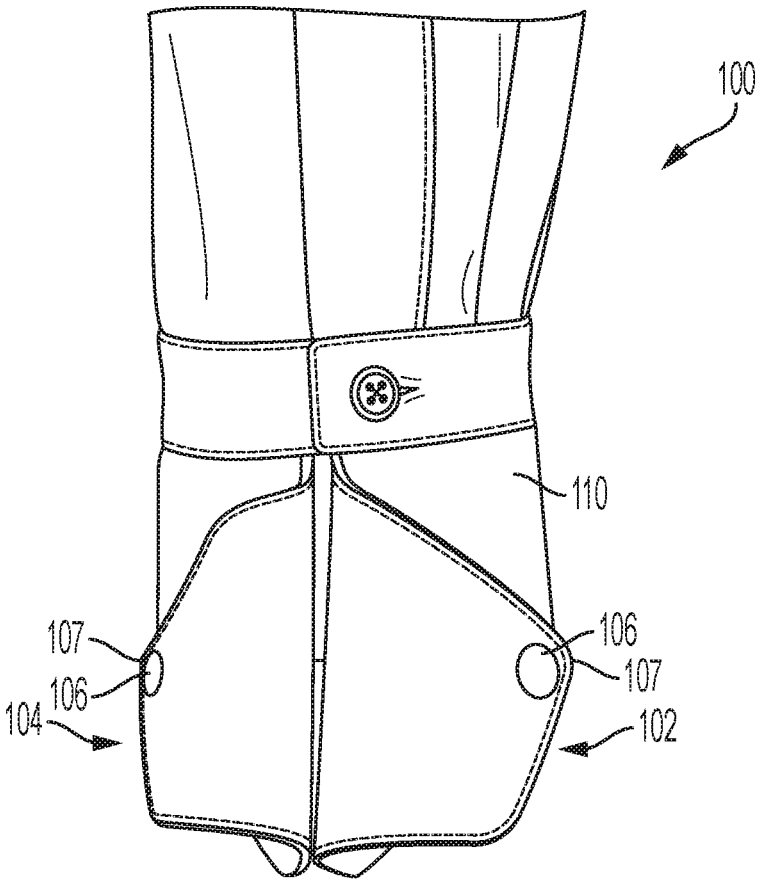
FIGS. 3-10 are perspective views of a sleeve of a garment with convertible sleeve cuffs arranged in a variety of styles.

FIGS. 3-10 show perspective views of a sleeve of a garment with convertible sleeve cuffs 100 according to the present invention where the cuffs are converted into a variety of styles. By way of example only, FIG. 3 is a perspective view of a garment with convertible sleeve cuffs 100 where the style shown is formed by folding each of the first extension 102 and the second extension 104 backwards onto the wrist portion 110 and connecting the one or more parts of the connector 106 on the tips 107 to the one or more parts of the connector 106 on the bases 105.

Figure 4A:
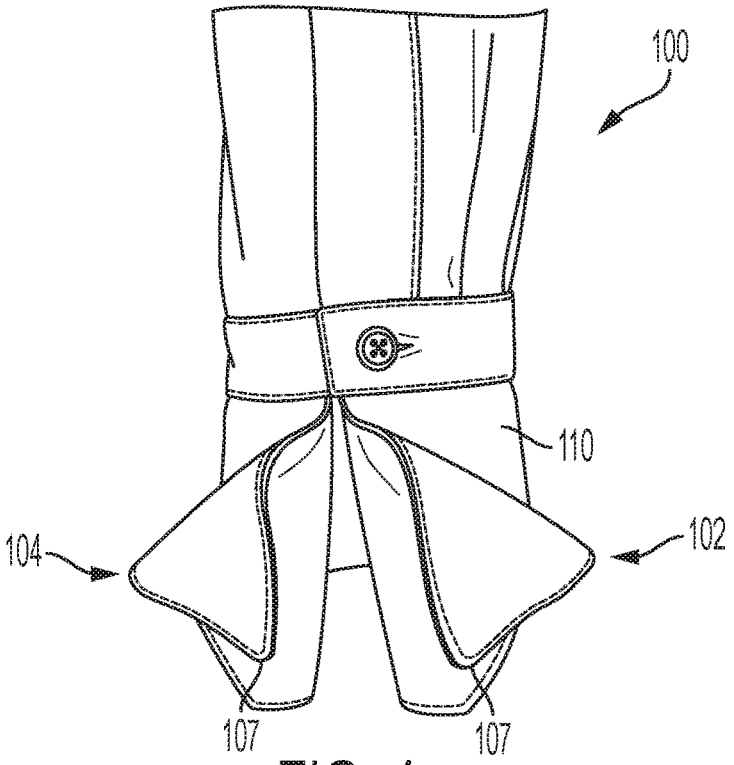
Figure 4B:
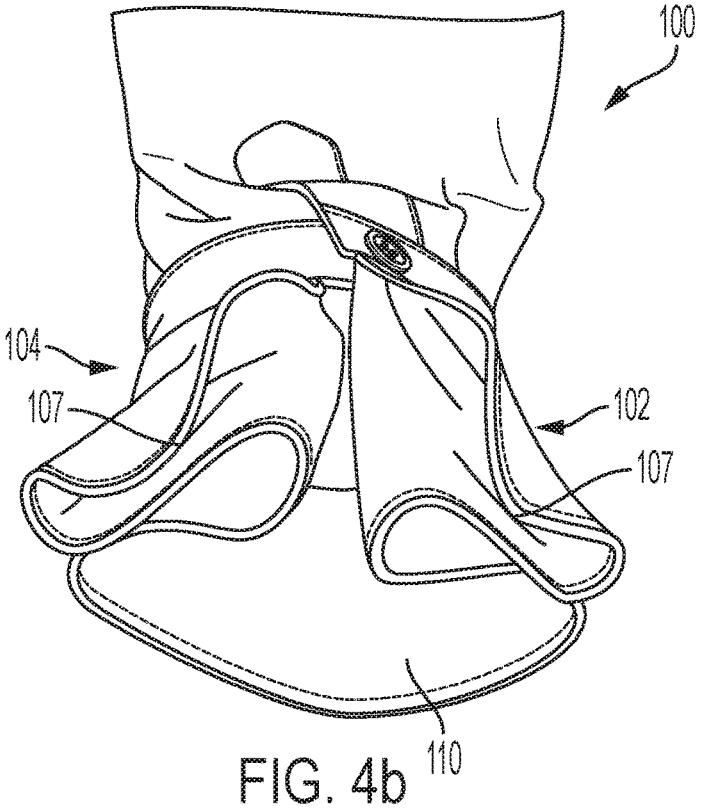

FIGS. 4*a* and 4*b* are perspective views of a sleeve of a garment with convertible sleeve cuff 100 where the connectors 106 are magnets and the style shown is formed by folding each of the first extension 102 and the second extension 104 backwards onto the wrist portion, thereafter taking the tip 107 of each of the first extension 102 and the second extension 104 and folding it forward such that the one or more parts of the connector 106 on the tips 107 connect to the one or more parts of the connector on the bases 105.

Figure 5A:
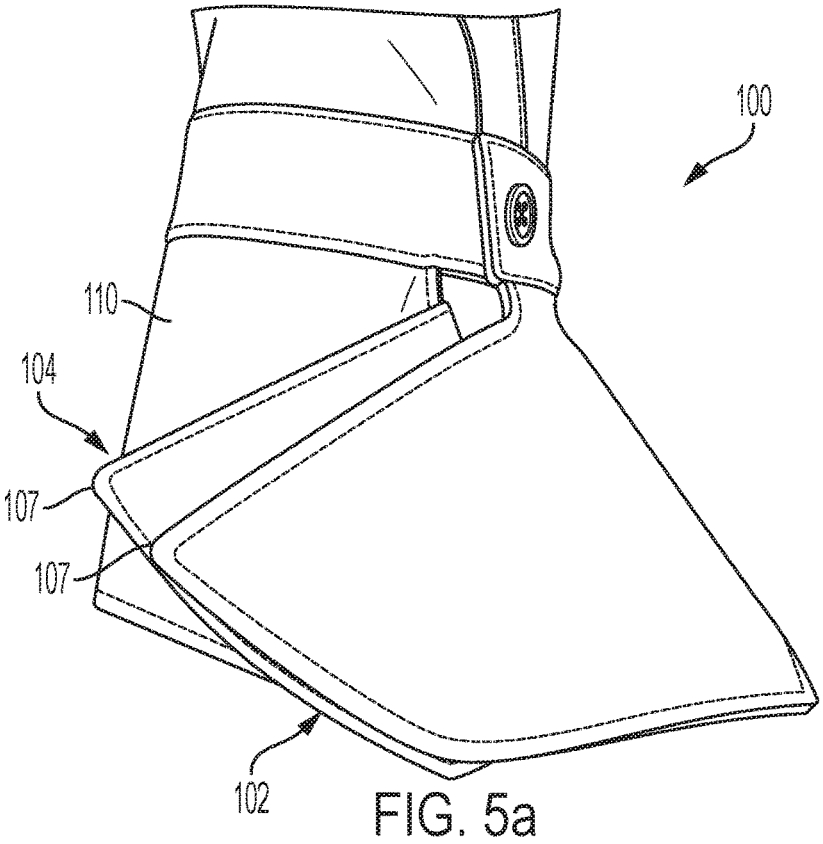
Figure 5B:
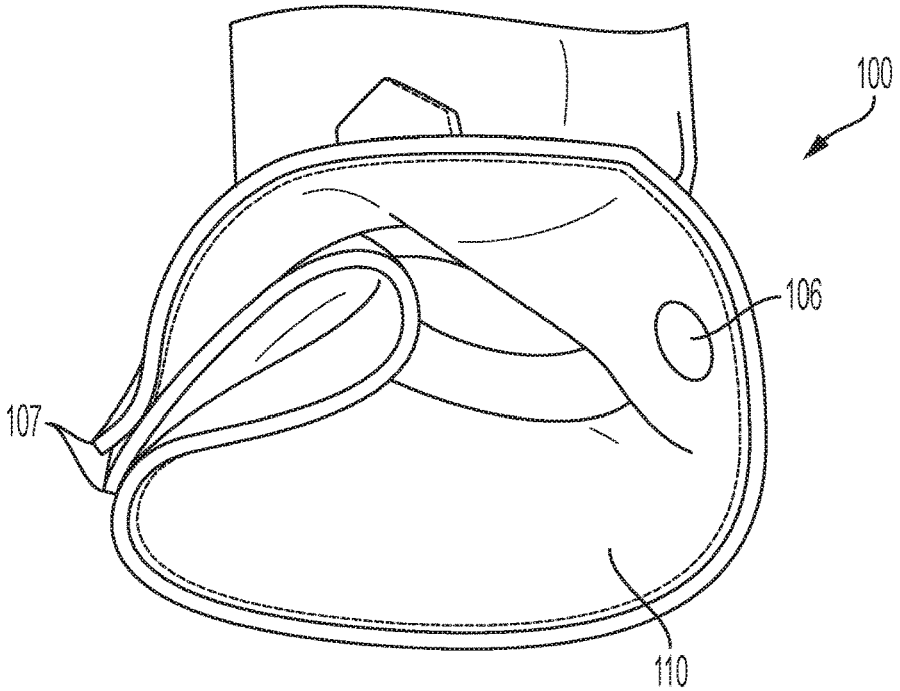

FIGS. 5*a* and 5*b* are perspective views of a sleeve of a garment with convertible sleeve cuffs 100 where the style shown is formed by folding the second extension 104 backwards toward the wrist portion 110 and connecting the one or more parts of the connector 106 on the tip 107 of the second extension 104 with the one or more parts of the connector 106 on the base 105. Thereafter, extending the first extension 102 over the second extension 104 and connecting the one or more parts of the connector 106 on the tip 107 of the first extension 102 to the one or more parts of the connector 106 on the base 105.

Figure 6:
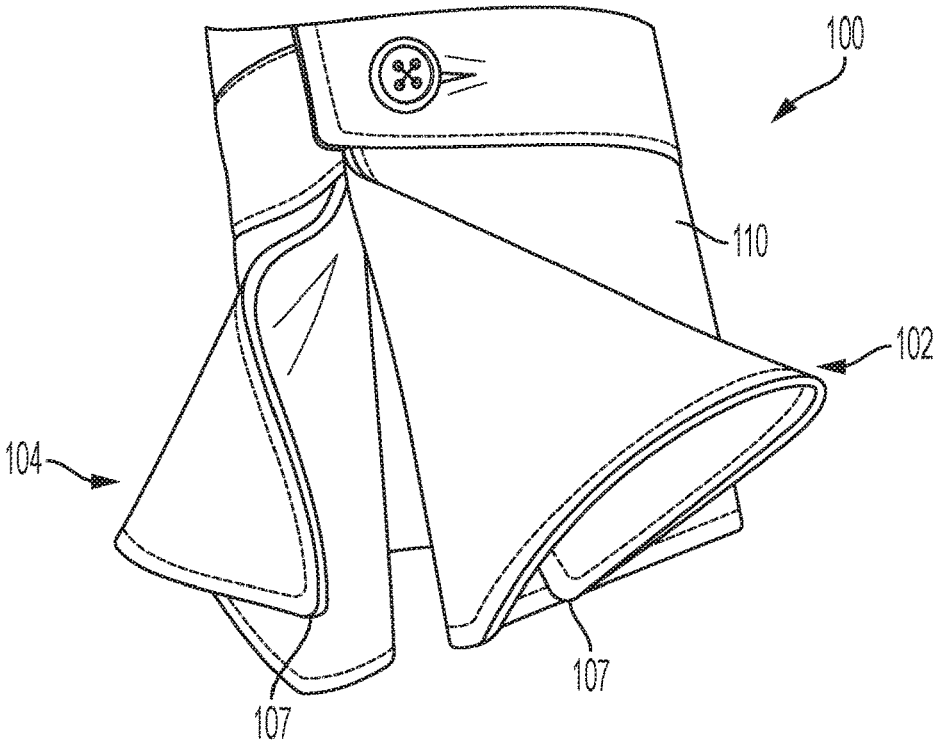

FIG. 6 shows a sleeve of a garment with convertible sleeve cuffs 100 where the style shown is formed by folding the second extension 104 backwards onto the wrist portion, thereafter taking the tip 107 of the second extension 104 and folding it forward such that the one or more parts of the connector 106 on the tip 107 connect to the one or more parts of the connector 106 on the corresponding base 105. Folding the first extension 102 backwards onto the wrist portion, curling it underneath itself to form a cone shape and connecting the one or more parts of the connector on the tip 107 to the one or more parts of the connector 106 on the corresponding base 105.

Figure 7:
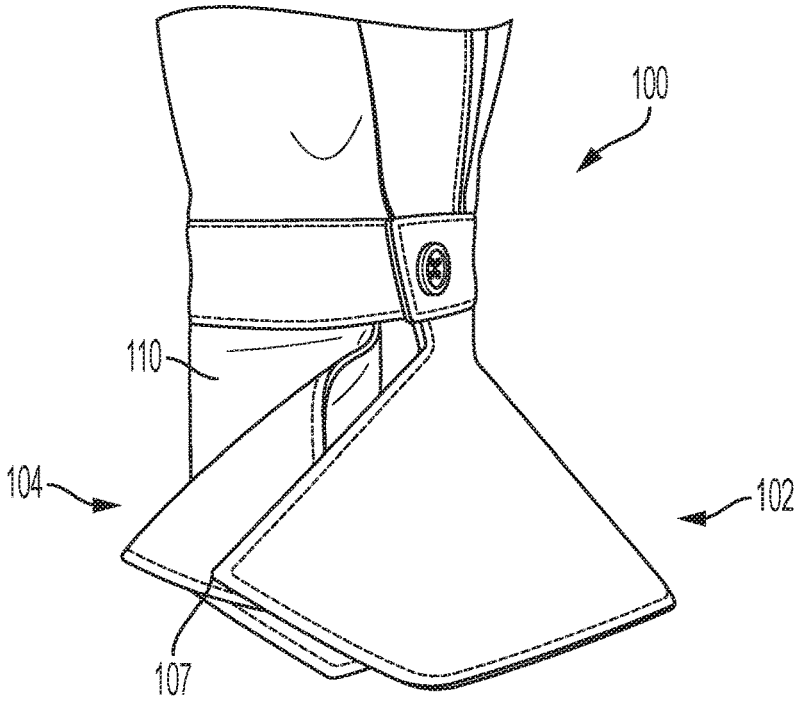

FIG. 7 shows a sleeve of a garment with convertible sleeve cuffs 100 where the style shown is formed by folding the second extension 104 backwards onto the wrist portion, thereafter taking the tip 107 of the second extension 104 and folding it forward to connect the one or more parts of the connector 106 on the tip 107 to the one or more parts of the connector 106 on the corresponding base 105. Thereafter, extending the first extension 102 over the second extension 104 and connecting the one or more parts of the connector 106 on the tip 107 of the first extension 102 to the one or more parts of the connector 106 on the tip 107 of the second extension 104.

Figure 8:
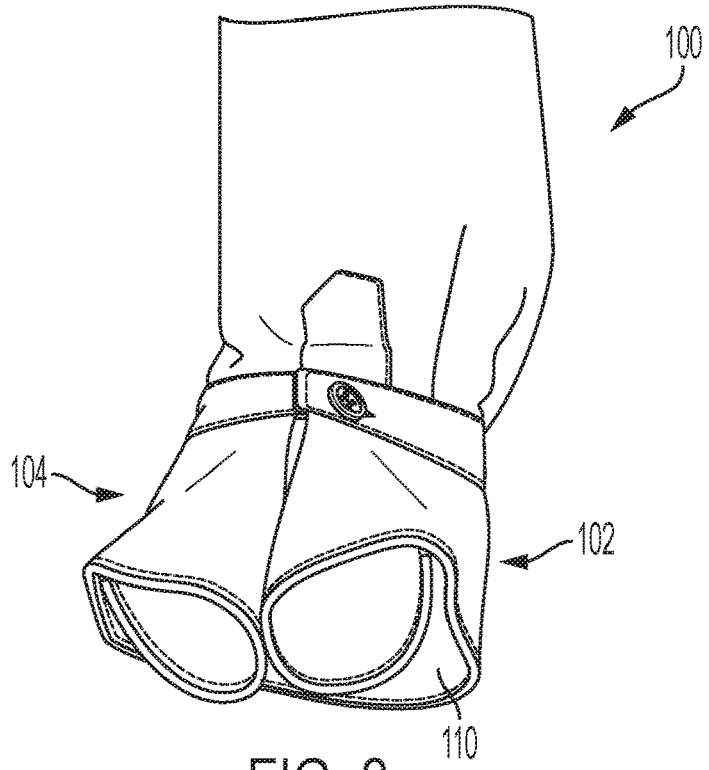

FIG. 8 shows a sleeve of a garment with convertible sleeve cuffs 100 where the style shown is formed by folding each of the first extension 102 and the second extension 104 inwards towards a wearers wrist, curling each of the first extension 102 and the second extension 104 into themselves to create a cone shape, and connecting the one or more parts of the connector 106 on the tips 107 to the one or more parts of the connector 106 on the corresponding bases 105.

Figure 9:
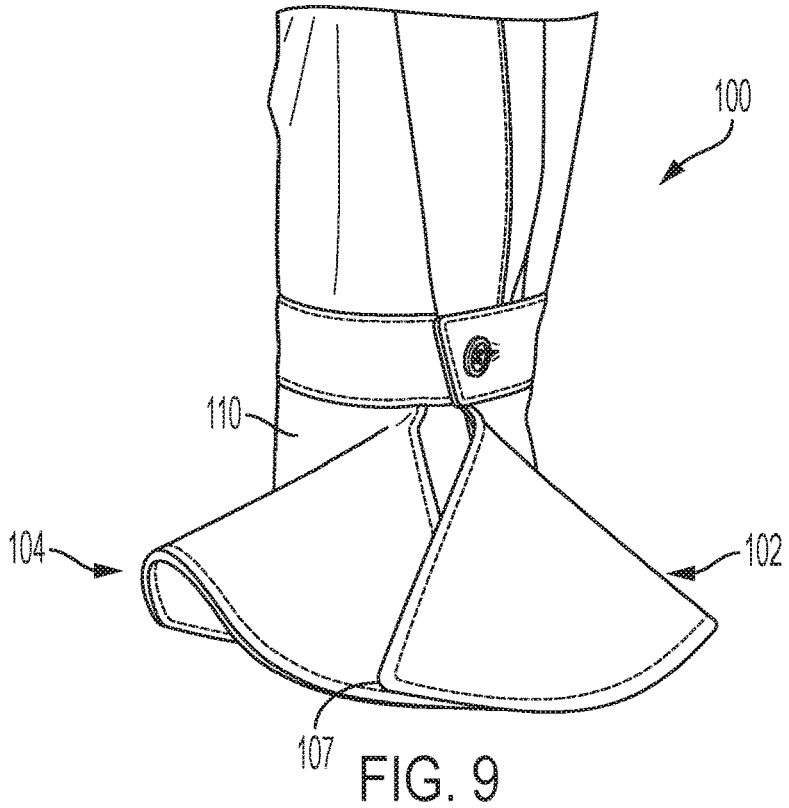

FIG. 9 shows a sleeve of a garment with convertible sleeve cuffs 100 where the style shown is formed by connecting the one or more parts of the connector 106 on the tips 107 of each of the first extension 102 and the second extension 104 to one another.

Figure 10A:
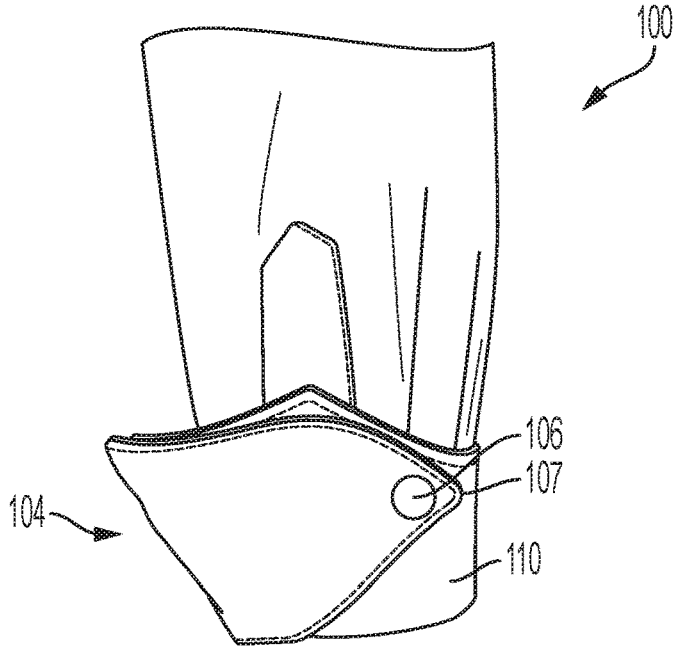
Figure 10B:
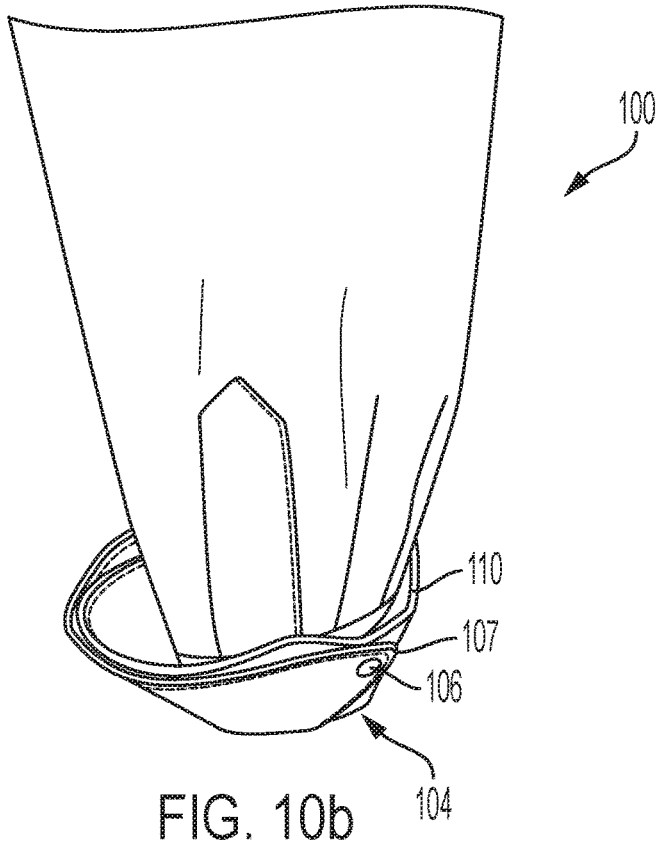

FIGS. 10*a* and 10*b* show a sleeve of a garment with convertible sleeve cuffs 100 where the style shown is formed by folding each of the first extension 102 and the second extension 104 upwards towards the wearers head, extending the first extension 102 towards the second extension 104, extending the second extension 104 over the first extension 102, connecting the one or more parts of the connector 106 on the tip 107 of the first extension 102 to the one or more parts of the connector 106 on the base 105 of the second extension 104, and connecting the one or more parts of the connector 106 on the tip 107 of the second extension 104 to the one or more parts of the connector 106 on the base 105 of the first extension 102.

It is to be understood that the present invention is not limited to the embodiments described above but encompasses any and all embodiments within the scope of the following claims.

What is claimed is:

1. A convertible sleeve cuff comprising:

a. a first extension having a first tip and a first base, wherein the first tip of the first extension is distal from the first base of the first extension and the first extension is connected to a wrist portion at the first base of the first extension, and wherein a first width of a portion of the first extension that includes the first base, is at least equal to the width of the wrist portion; and b. a second extension having a second tip and a second base, wherein the second tip of the second extension is distal from the second base of the second extension and the second extension is connected to the wrist portion at the second base of the second extension, and wherein a second width of a portion of the second extension that includes the second base is at least equal to the width of the wrist portion;

c. the first extension and the second extension each comprising of a connector, the connectors each comprising of two or more corresponding parts, wherein the two or more corresponding parts of the connectors are equally divided on the tips and the bases;

d. the sleeve cuff constructed by a sewing pattern, wherein the portions of the sewing pattern for constructing the extensions each comprising a first triangle adjacent to a second triangle the first triangle connected to the second triangle by an ease, and a third triangle adjacent to the second triangle the third triangle connected to the second triangle by an ease.

2. The convertible sleeve cuff of claim 1, wherein the connector comprises of magnets.

3. The convertible sleeve cuff of claim 1, wherein the connectors are detachable from the sleeve cuffs.

4. A garment with convertible sleeve cuffs comprising:

a. a body having a right sleeve and a left sleeve, wherein the right sleeve and the left sleeve are each configured to start at a wearer's right shoulder and left shoulder respectively and reach a wearers right wrist and left wrist respectively when worn; and b. a garment sleeve cuff attached to the wrist end of each of the right sleeve and the left sleeve, each of the garment sleeve cuffs comprising:

i. a first extension having a first tip and a first base, wherein the first tip of the first extension is distal from the first base of the first extension and the first extension is connected to a wrist portion at the first base of the first extension, and wherein a first width of a portion of the first extension that includes the first base is at least equal to the width of the wrist portion; and ii. a second extension having a second tip and a second base, wherein the second tip of the second extension is distal from the second base of the second extension and the second extension is connected to the wrist portion at the second base of the second extension, and wherein a second width of a portion of the second extension that includes the second base is at least equal to the width of the wrist portion; and iii. the first extension and the second extension each comprising of a connector, the connectors each comprising of two or more corresponding parts, wherein the two or more corresponding parts of the connectors are equally divided on the tips and the bases;

iv. each of the sleeve cuffs constructed using a sewing pattern, wherein the portions of the sewing pattern for constructing the extensions each comprising a first triangle adjacent to a second triangle the first triangle connected to the second triangle by an ease, and a third triangle adjacent to the second triangle the third triangle connected to the second triangle by an ease.

5. The garment with convertible sleeve cuffs of claim 4, wherein the connector comprises of magnets.

6. The garment with convertible sleeve cuffs of claim 4, wherein the connectors are detachable from the sleeve cuffs.

7. The garment with convertible sleeve cuffs of claim 4, wherein the garment sleeve cuffs are detachable from the garment.

* * * * *